US007428492B2

(12) United States Patent
Yamada

(10) Patent No.: US 7,428,492 B2
(45) Date of Patent: Sep. 23, 2008

(54) SPEECH SYNTHESIS DICTIONARY CREATION APPARATUS, METHOD, AND COMPUTER-READABLE MEDIUM STORING PROGRAM CODES FOR CONTROLLING SUCH APPARATUS AND PITCH-MARK-DATA FILE CREATION APPARATUS, METHOD, AND COMPUTER-READABLE MEDIUM STORING PROGRAM CODES FOR CONTROLLING SUCH APPARATUS

(75) Inventor: Masayuki Yamada, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 138 days.

(21) Appl. No.: 11/345,499

(22) Filed: Feb. 2, 2006

(65) Prior Publication Data

US 2006/0129404 A1 Jun. 15, 2006

Related U.S. Application Data

(62) Division of application No. 09/262,852, filed on Mar. 5, 1999, now Pat. No. 7,054,806.

(30) Foreign Application Priority Data

Mar. 9, 1998 (JP) ..... 10-057250

(51) Int. Cl.
*G10L 13/02* (2006.01)

(52) U.S. Cl. ..... 704/265

(58) Field of Classification Search ..... 704/265, 704/268

See application file for complete search history.

(56) References Cited

U.S. PATENT DOCUMENTS 4,296,279 A * 10/1981 Stork ..... 704/264
5,133,010 A * 7/1992 Borth et al. ..... 704/264
5,479,564 A 12/1995 Vogten et al.
5,524,172 A * 6/1996 Hamon ..... 704/268
5,630,011 A 5/1997 Lim et al.
5,682,501 A 10/1997 Sharman
5,787,396 A 7/1998 Komori et al.
5,787,398 A * 7/1998 Lowry ..... 704/268
5,797,116 A 8/1998 Yamada et al.
5,864,812 A 1/1999 Kamai et al.

(Continued)

FOREIGN PATENT DOCUMENTS

EP 0 696 026 2/1996

(Continued)

OTHER PUBLICATIONS

Speech synthesis in the time domain from text;Grossmann, E.; Acoustics, Speech, and Signal Processing, IEEE International Conference on ICASSP '82. vol. 7, May 1982 pp. 936-939.*

(Continued)

*Primary Examiner*—Michael N Opsasnick
(74) *Attorney, Agent, or Firm*—Fitzpatrick, Cella, Harper & Scinto

(57) ABSTRACT

The distance between the first two pitch marks of a voiced portion of speech data to be processed is calculated. The difference between the adjacent inter-pitch-mark distances is calculated. The respective calculation results are stored and managed in a file.

13 Claims, 7 Drawing Sheets

U.S. PATENT DOCUMENTS

| | | | |
|---|---|---|---|
| 5,884,253 | A | 3/1999 | Kleijn |
| 5,890,118 | A | 3/1999 | Kagoshima et al. |
| 5,924,067 | A | 7/1999 | Kosaka et al. |
| 6,125,344 | A | 9/2000 | Kang et al. |
| 6,169,240 | B1 | 1/2001 | Suzuki |
| 6,236,962 | B1 | 5/2001 | Kosaka et al. |
| 6,662,159 | B2 | 12/2003 | Komori et al. |
| 6,813,571 | B2 | 11/2004 | Lightbody et al. |

FOREIGN PATENT DOCUMENTS

| | | |
|---|---|---|
| EP | 0 703 565 | 3/1996 |
| JP | 59-68793 | 4/1984 |
| JP | 6-232762 | 8/1994 |
| JP | 8-160991 | 6/1996 |
| JP | 8-263090 | 10/1996 |

OTHER PUBLICATIONS

Microphonemic method of speech synthesis;Lukaszewicz, K.; Karjalainen, M.;Acoustics, Speech, and Signal Processing, IEEE International Conference on ICASSP '87.vol. 12, Apr. 1987 pp. 1426-1429 □□.*

Gerson et al., "Techniques for Improving the Performance of CELP-Type Speech Coders," IEEE Journal on Selected Areas in Communications, US, IEEE, Inc., vol. 10, No. 5, Jun. 10, 1992, pp. 858-865.

Kortekaas et al., "Psychoacoustical Evaluation on the Pitch Synchronous Overlap and Add Speech-Waveform Manipulation Technique Using Single-Format Stimuli," Journal of the Acoustical Society of America, Apr. 1997, Acoust. Soc. America through AIP, vol. 101, No. 4, pp. 2202-2213.

* cited by examiner

SPEECH SYNTHESIS DICTIONARY CREATION APPARATUS, METHOD, AND COMPUTER-READABLE MEDIUM STORING PROGRAM CODES FOR CONTROLLING SUCH APPARATUS AND PITCH-MARK-DATA FILE CREATION APPARATUS, METHOD, AND COMPUTER-READABLE MEDIUM STORING PROGRAM CODES FOR CONTROLLING SUCH APPARATUS

This is a divisional application of application Ser. No. 09/262,852, filed on Mar. 5, 1999 now U.S. Pat. No. 7,054,806.

BACKGROUND OF THE INVENTION

The present invention relates to a speech synthesis apparatus for performing speech synthesis by using pitch marks, a control method for the apparatus, and a computer-readable memory.

Conventionally, processing that synchronizes with pitches has been performed as speech analysis/synthesis processing and the like. For example, in a PSOLA (Pitch Synchronous OverLap Adding) speech synthesis method, synthetic speech is obtained by adding one-pitch speech waveform element pieces in synchronism with pitches.

In this scheme, information (pitch mark) about the position of each pitch must be recorded concurrently with the storage of speech waveform data.

In the prior art described above, however, the size of a file on which pitch marks are recorded becomes undesirably large.

SUMMARY OF THE INVENTION

The present invention has been made in consideration of the above problem, and has as its object to provide a speech synthesis apparatus capable of reducing the size of a file used to manage pitch marks, a control method therefor, and a computer-readable memory.

In order to achieve the above object, a speech synthesis apparatus according to the present invention has the following arrangement.

There is provided a speech synthesis apparatus for performing speech synthesis by using pitch marks, comprising:

first calculation means for calculating the distance between first two pitch marks of a voiced portion of speech data to be processed;

second calculation means for calculating the difference between adjacent inter-pitch-mark distances; and management means for storing the calculation results obtained by the first and second calculation means in a file and managing the results.

In order to achieve the above object, a speech synthesis apparatus according to the present invention has the following arrangement.

There is provided a speech synthesis apparatus for performing speech synthesis by using pitch marks, comprising:

first comparison means for, when a length of speech data to be processed is represented by d, and a maximum value dmax and a minimum value dmin are defined for a predetermined word length, comparing the length d with the maximum value dmax;

second comparison means for comparing the length d with the minimum value dmin on the basis of the comparison result obtained by the first comparing means;

subtraction means for subtracting the maximum value dmax or the minimum value dmin from the length d on the basis of the comparison results obtained by the first and second comparison means; and management means for storing the difference obtained by the subtraction means or the length d in the file and managing the difference or the length on the basis of the comparison results obtained by the first and second comparison means.

In order to achieve the above object, a speech synthesis apparatus according to the present invention has the following arrangement.

There is provided a speech synthesis apparatus for performing speech synthesis by using pitch marks, comprising:

storage means for storing a file for, managing the distance between first two pitch marks of a voiced portion of speech data to be processed and the difference between adjacent inter-pitch-mark distances;

first loading means for loading the distance between the first two pitch marks of the voiced portion;

second loading means for loading the difference between the adjacent inter-pitch-mark distances; and calculation means for calculating the next pitch mark position from a pitch mark position calculated immediately before the calculation, the pitch mark distance to an adjacent pitch mark, and the distance and difference loaded by the first and second loading means.

In order to achieve the above object, a control method for a speech synthesis apparatus according to the present invention has the following steps.

There is provided a control method for a speech synthesis apparatus for performing speech synthesis by using pitch marks, comprising:

a first calculation step of calculating the distance between first two pitch marks of a voiced portion of speech data to be processed;

a second calculation step of calculating the difference between adjacent inter-pitch-mark distances; and a management step of storing the calculation results obtained in the first and second calculation steps in a file and managing the results.

In order to achieve the above object, a control method for a speech synthesis apparatus according to the present invention has the following steps.

There is provided a control method for a speech synthesis apparatus for performing speech synthesis by using pitch marks, comprising:

a first comparison step of, when the length of speech data to be processed is represented by d, and the maximum value dmax and a minimum value dmin are defined for a predetermined word length, comparing the length d with the maximum value dmax;

a second comparison step of comparing the length d with the minimum value dmin on the basis of the comparison result obtained in the first comparing step;

a subtraction step of subtracting the maximum value dmax or the minimum value dmin from the length d on the basis of the comparison results obtained in the first and second comparison steps; and a management step of storing the difference obtained in the subtraction step or the length d in the file and managing the difference or the length on the basis of the comparison results obtained in the first and second comparison steps.

In order to achieve the above object, a control method for a speech synthesis apparatus according to the present invention has the following steps.

There is provided a control method for a speech synthesis apparatus for performing speech synthesis by using pitch marks, comprising:

a storage step of storing a file for managing the distance between the first two pitch marks of a voiced portion of speech data to be processed and the difference between adjacent inter-pitch-mark distances;

a first loading step of loading the distance between the first two pitch marks of the voiced portion;

a second loading step of loading the difference between the adjacent inter-pitch-mark distances; and a calculation step of calculating a next pitch mark position from a pitch mark position calculated immediately before the calculation, a pitch mark distance to an adjacent pitch mark, and the distance and difference loaded in the first and second loading steps.

In order to achieve the above object, a computer-readable memory according to the present invention has the following program codes.

There is provided a computer-readable memory storing program codes for controlling a speech synthesis apparatus for performing speech synthesis by using pitch marks, comprising:

a program code for the first calculation step of calculating the distance between the first two pitch marks of a voiced portion of speech data to be processed;

a program code for the second calculation step of calculating the difference between adjacent inter-pitch-mark distances; and a program code for the management step of storing the calculation results obtained in the first and second calculation steps in a file and managing the results.

In order to achieve the above object, a computer-readable memory according to the present invention has the following program codes.

There is provided a computer-readable memory storing program codes for controlling a speech synthesis apparatus for performing speech synthesis by using pitch marks, comprising:

a program code for the first comparison step of, when the length of speech data to be processed is represented by d, and the maximum value dmax and a minimum value dmin are defined for a predetermined word length, comparing the length d with the maximum value dmax;

a program code for the second comparison step of comparing the length d with the minimum value dmin on the basis of the comparison result obtained in the first comparing step;

a program code for the subtraction step of subtracting the maximum value dmax or the minimum value dmin from the length d on the basis of the comparison results obtained in the first and second comparison steps; and a program code for the management step of storing the difference obtained in the subtraction step or the length d in the file and managing the difference or the length on the basis of the comparison results obtained in the first and second comparison steps.

In order to achieve the above object, a computer-readable memory according to the present invention has the following program codes.

There is provided a computer-readable memory storing program codes for controlling a speech synthesis apparatus for performing speech synthesis by using pitch marks, comprising:

a program code for the storage step of storing a file for managing the distance between the first two pitch marks of a voiced portion of speech data to be processed and the difference between adjacent inter-pitch-mark distances;

a program code for the first loading step of loading the distance between the first two pitch marks of the voiced portion;

a program code for the second loading step of loading the difference between the adjacent inter-pitch-mark distances; and a program code for the calculation step of calculating a next pitch mark position from a pitch mark position calculated immediately before the calculation, a pitch mark distance to an adjacent pitch mark, and the distance and difference loaded in the first and second loading steps.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

First Embodiment

Figure 1:
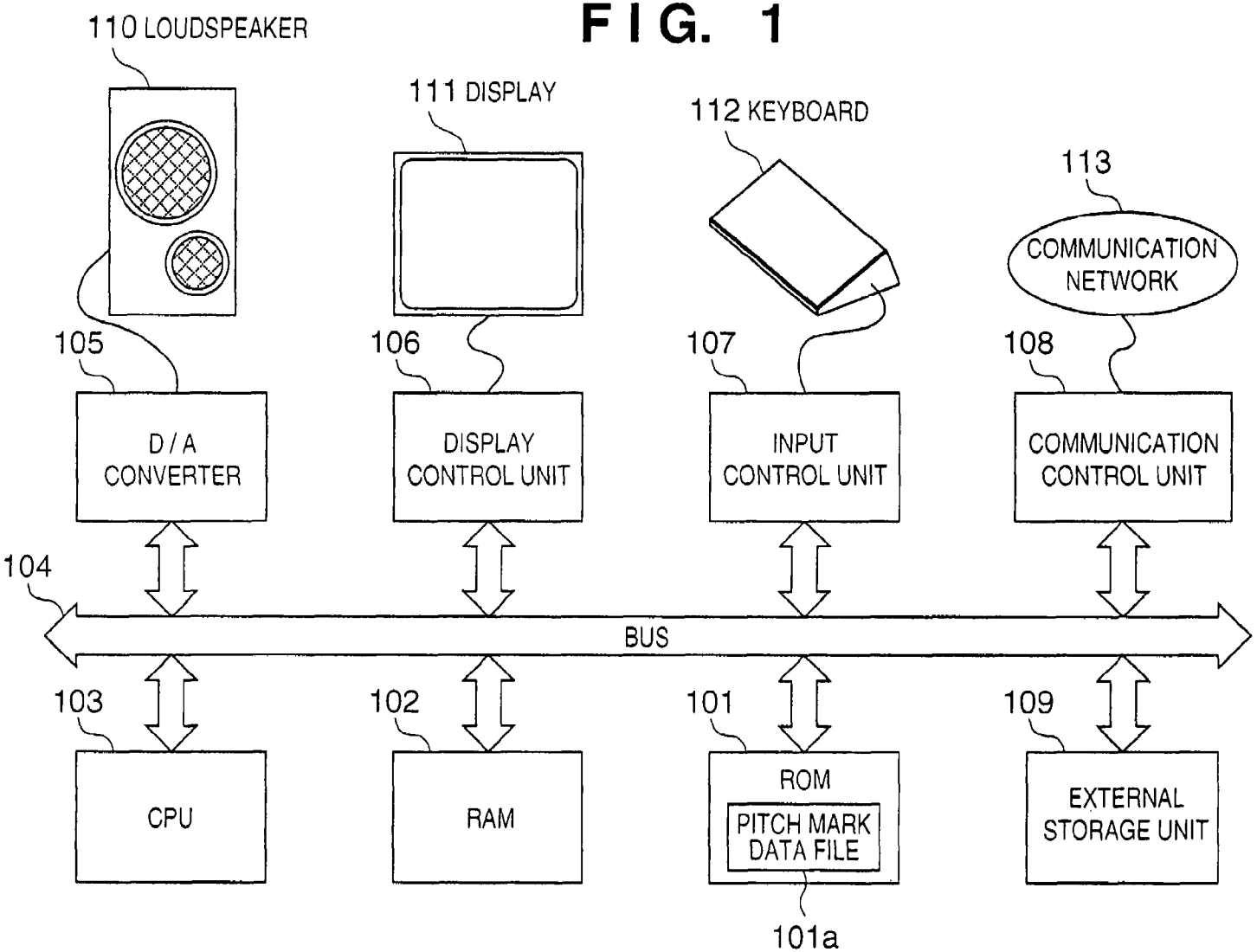
FIG. 1 is a block diagram showing the arrangement of a speech synthesis apparatus according to the first embodiment of the present invention.

FIG. 1 is a block diagram showing the arrangement of a speech synthesis apparatus according to the first embodiment of the present invention.

Reference numeral 103 denotes a CPU for performing numerical operation/control, control on the respective components of the apparatus, and the like, which are executed in the present invention; 102 denotes a RAM serving as a work area for processing executed in the present invention, a temporary saving area for various data and having an area for storing a pitch-mark-data file 101*a*; 101 denotes a ROM storing various control programs such as programs executed in the present invention, for managing pitch-mark data used for speech synthesis; 109 denotes an external storage unit serving as an area for storing processed data; and 105 denotes a D/A converter for converting the digital speech data synthesized by the speech synthesis apparatus into analog speech data and outputting it from a loudspeaker 110.

Reference numeral 106 denotes a display control unit for controlling a display 111 when the processing state and processing results of the speech synthesis apparatus, and a user interface are to be displayed; 107 denotes an input control unit for recognizing key information input from a keyboard 112 and executing the designated processing; 108 denotes a communication control unit for controlling transmission/reception of data through a communication network 113; and 104 denotes a bus for connecting the respective components of the speech synthesis apparatus to each other.

Pitch-mark-data, file-generation processing executed in the first embodiment will be described next with reference to FIG. 2.

Figure 2:
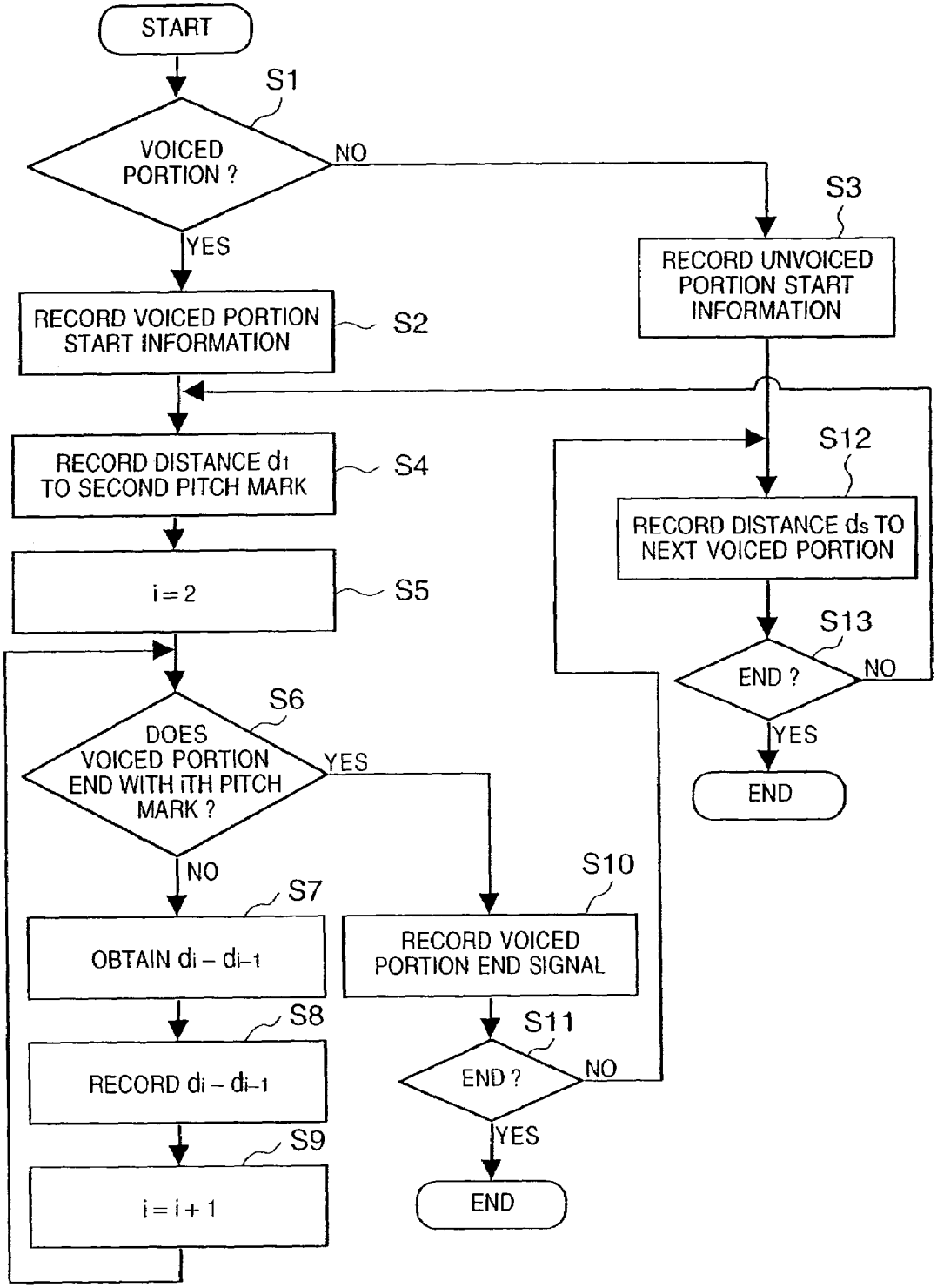
FIG. 2 is a flow chart showing pitch-mark-data, file-generation processing executed in the first embodiment of the present invention.

FIG. 2 is a flow chart showing pitch-mark-data, file generation processing executed in the first embodiment of the present invention.

Figure 3:
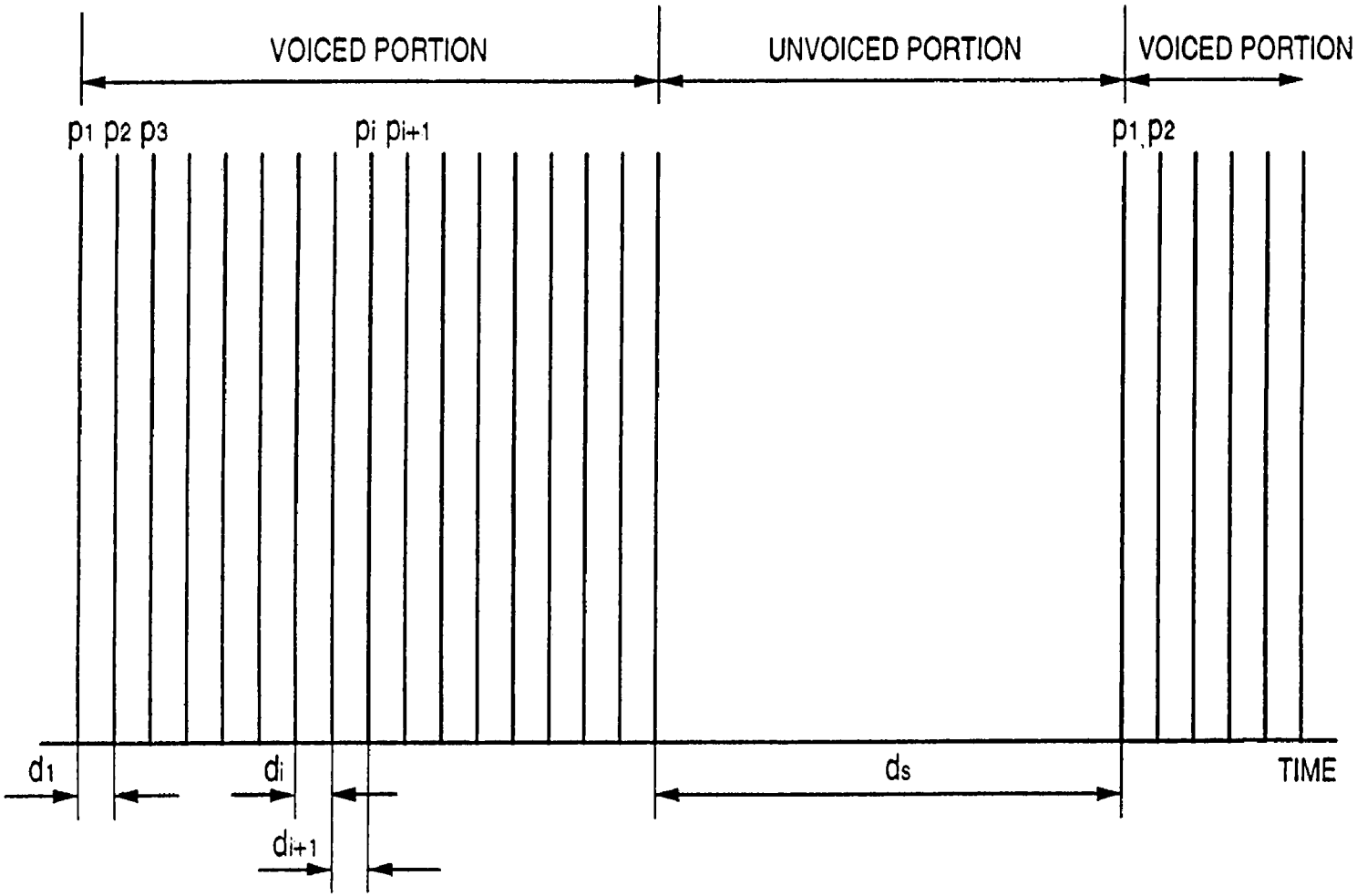
FIG. 3 is a view for explaining pitch marks in the first embodiment of the present invention.

As shown in FIG. 3, pitch marks $p_1, p_2, \ldots, p_i, p_{i+1}$ are arranged in each voiced portion at certain intervals, but no pitch mark is present in any unvoiced portion.

First of all, it is checked in step S1 whether the first segment of speech data to be processed is a voiced or unvoiced portion. If it is determined that the first segment is a voiced portion (YES in step S1), the flow advances to step S2. If it is determined that the first segment is an unvoiced portion (NO in step S1), the flow advances to step S3.

In step S2, voiced portion start information indicating that "the first segment is a voiced portion" is recorded. In step S4, a first inter-pitch-mark distance (distance between the first pitch mark $p_1$ and the second pitch mark $p_2$ of the voiced portion) $d_1$ is recorded in the pitch mark data file 101*a*. In step S5, the value of a loop counter i is initialized to 2.

It is then checked in step S6 whether the voiced portion ends with the ith pitch mark $p_i$ indicated by the value of the loop counter i. If it is determined that the voiced portion does not end with the pitch mark $p_i$ (NO in step S6), the flow advances to step S7 to obtain the difference $(d_i-d_{i-1})$ between an inter-pitch-mark distance $d_i$ and an inter-pitch-mark distance $d_{i-1}$. In step S8, the obtained difference $(d_i-d_{i-1})$ is recorded in the pitch mark data file 101*a*. In step S9, the loop counter i is incremented by 1, and the flow returns to step S6.

If it is determined that the voiced portion ends (YES in step S6), the flow advances to step S10 to record a voiced portion end signal indicating the end of the voiced portion in the pitch-mark-data file 101*a*. Note that any signal can be used as the voiced portion end signal as long as it can be discriminated from an inter-pitch-mark distance. In step S11, it is checked whether the speech data has ended. If it is determined that the speech data has not ended (NO in step S11), the flow advances to step S12. If it is determined that the speech data has ended (YES in step S11), the processing is terminated.

It is determined in step S1 that the first segment of the speech data is an unvoiced portion (NO in step S1), the flow advances to step S3 to record unvoiced portion start information indicating that "the first segment is an unvoiced portion" in the pitch mark data file 101*a*. In step S12, the distance $d_S$ between the voiced portion and the next voiced portion (i.e., the length of the unvoiced portion) is recorded in the pitch mark data file 101*a*. In step S13, it is checked whether the speech data has ended. If it is determined that the speech data has not ended (NO in step S13), the flow advances to step S4. If it is determined that the speech data has ended (YES in step S13), the processing is terminated.

As described above, according to the first embodiment, since the respective pitch marks in each voiced portion are managed by using the distances between the adjacent pitch marks, all the pitch marks in each voiced portion need not be managed. This can reduce the size of the pitch-mark-data file 101*a*.

Figure 4:
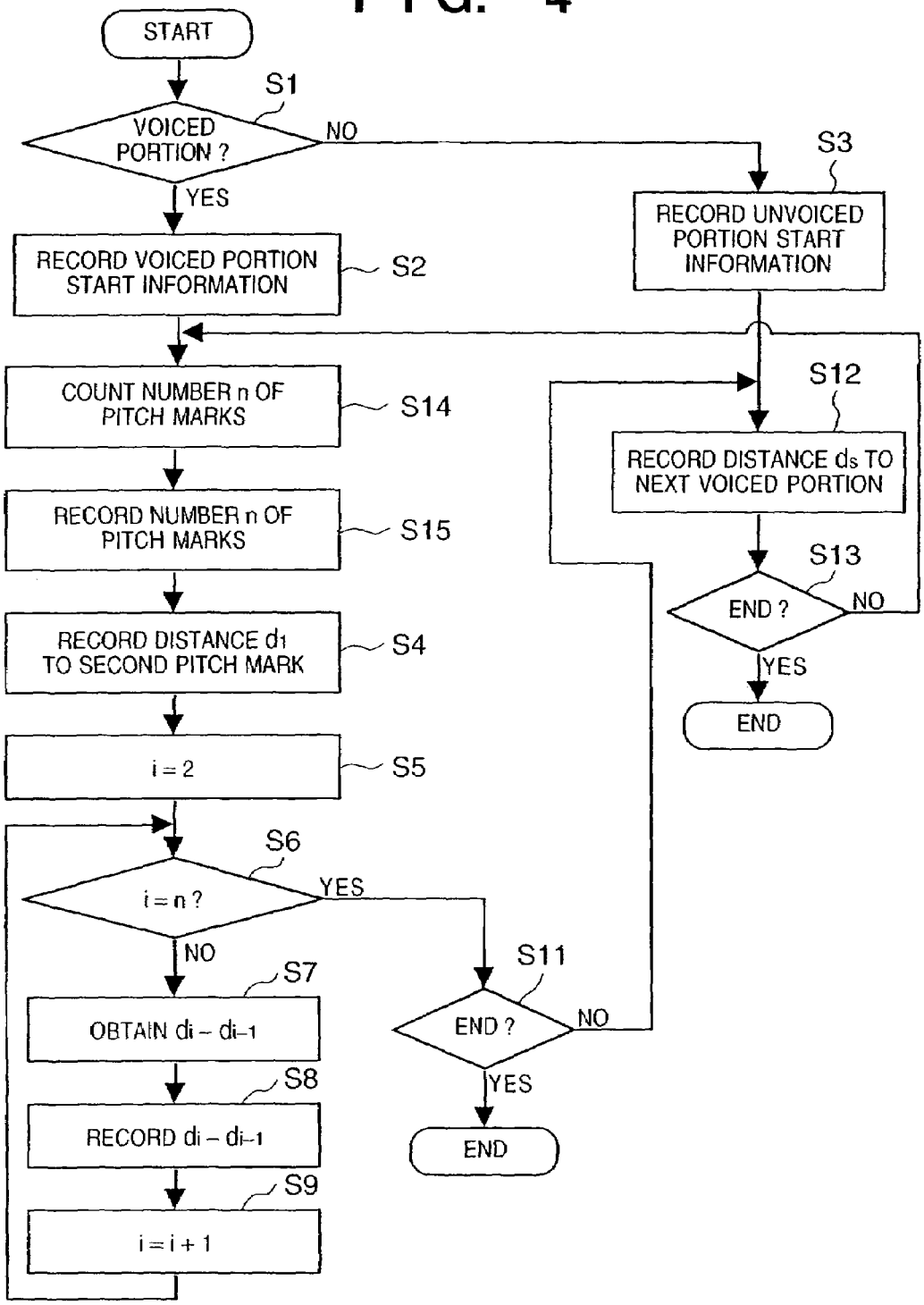
FIG. 4 is a flow chart showing another example of the pitch mark data file generation processing executed in the first embodiment of the present invention.

In the first embodiment, step S10 may be replaced with step S14 of counting the number (n) of pitch marks in each voiced portion and step S15 of recording the counted number n of pitch marks in the pitch-mark-data file 101*a*, as shown in FIG. 4. In this case, the processing in step S6 amounts to checking whether the value of the loop counter i is equal to the number n of pitch marks.

Another example of the processing of recording pitch marks of each voiced portion in the first embodiment will be described with reference to FIG. 5.

Figure 5:
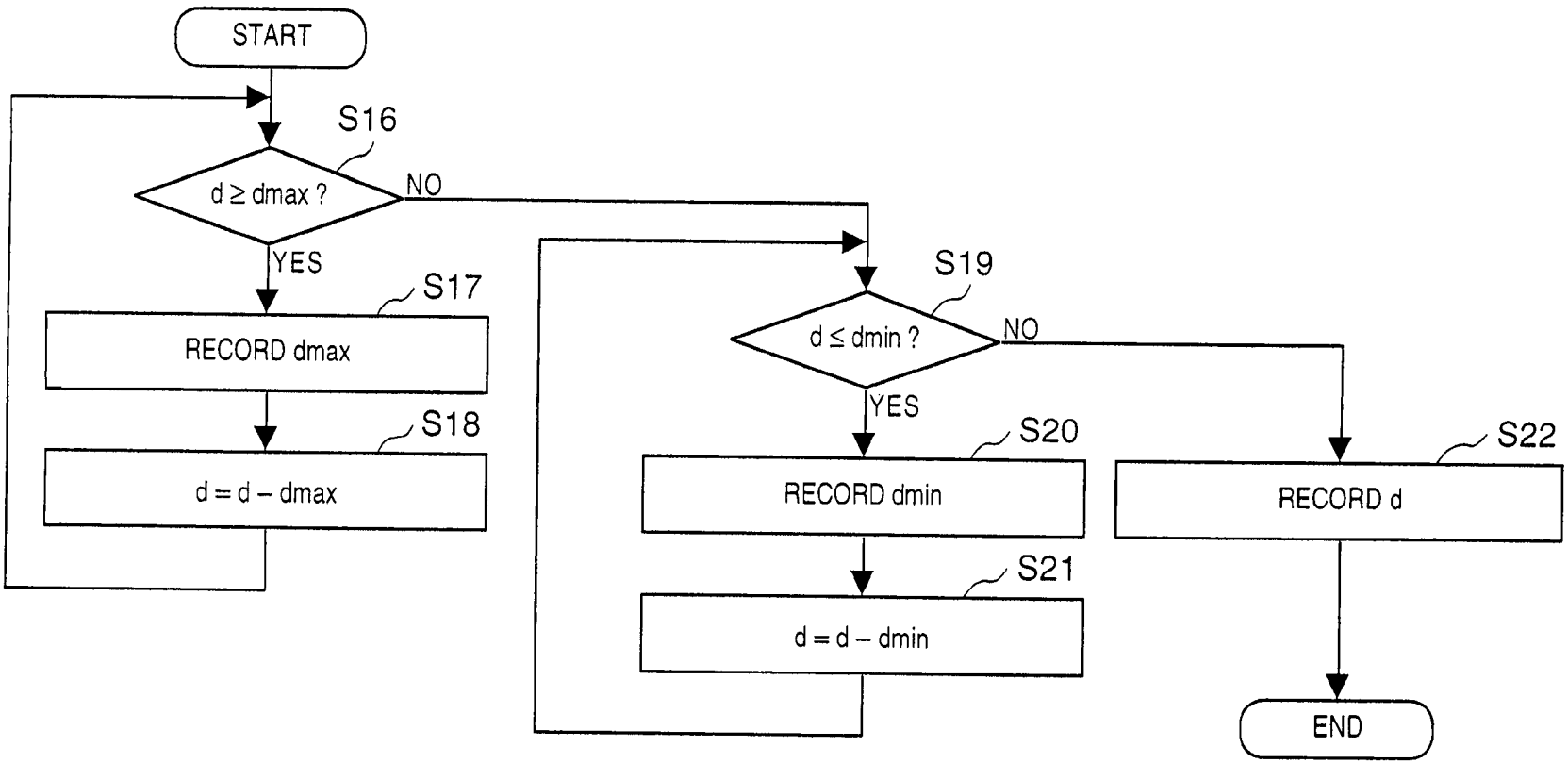
FIG. 5 is a flow chart showing another example of the processing of recording the pitch marks of a voiced portion in the first embodiment of the present invention.

FIG. 5 is a flow chart showing another example of the processing of recording pitch marks of each voiced portion in the first embodiment of the present invention.

For example, the data length of speech data to be processed is represented by d, and a maximum value dmax (e.g., 127) and a minimum value dmin (e.g., −127) are defined for a given word length (e.g., 8 bits).

First of all, in step S16, d is compared with dmax. If d is equal to or larger than dmax (YES in step S16), the flow advances to step S17 to record the maximum value dmax in the pitch-mark-data file 101*a*. In step S18, dmax is subtracted from d, and the flow returns to step S16. If it is determined that d is smaller than dmax (NO in step S16), the flow advances to step S19.

In step S19, d is compared with dmin. If d is equal to or smaller than dmin (YES in step S19), the flow advances to step S20 to record the minimum value dmin in the pitch mark data file 101*a*. In step S21, dmin is subtracted from d, and the flow returns to step S19. If it is determined that d is larger than dmin (NO in step S19), the flow advances to step S22 to record d. The processing is then terminated.

With this recording, for example, dmin−1 (−128 in the above case) can be used as a voiced portion end signal.

Second Embodiment

In the second embodiment, pitch-mark-data-file loading processing of loading data from the pitch-mark-data file 101*a* recorded in the first embodiment will be described with reference to FIG. 6.

Figure 6:
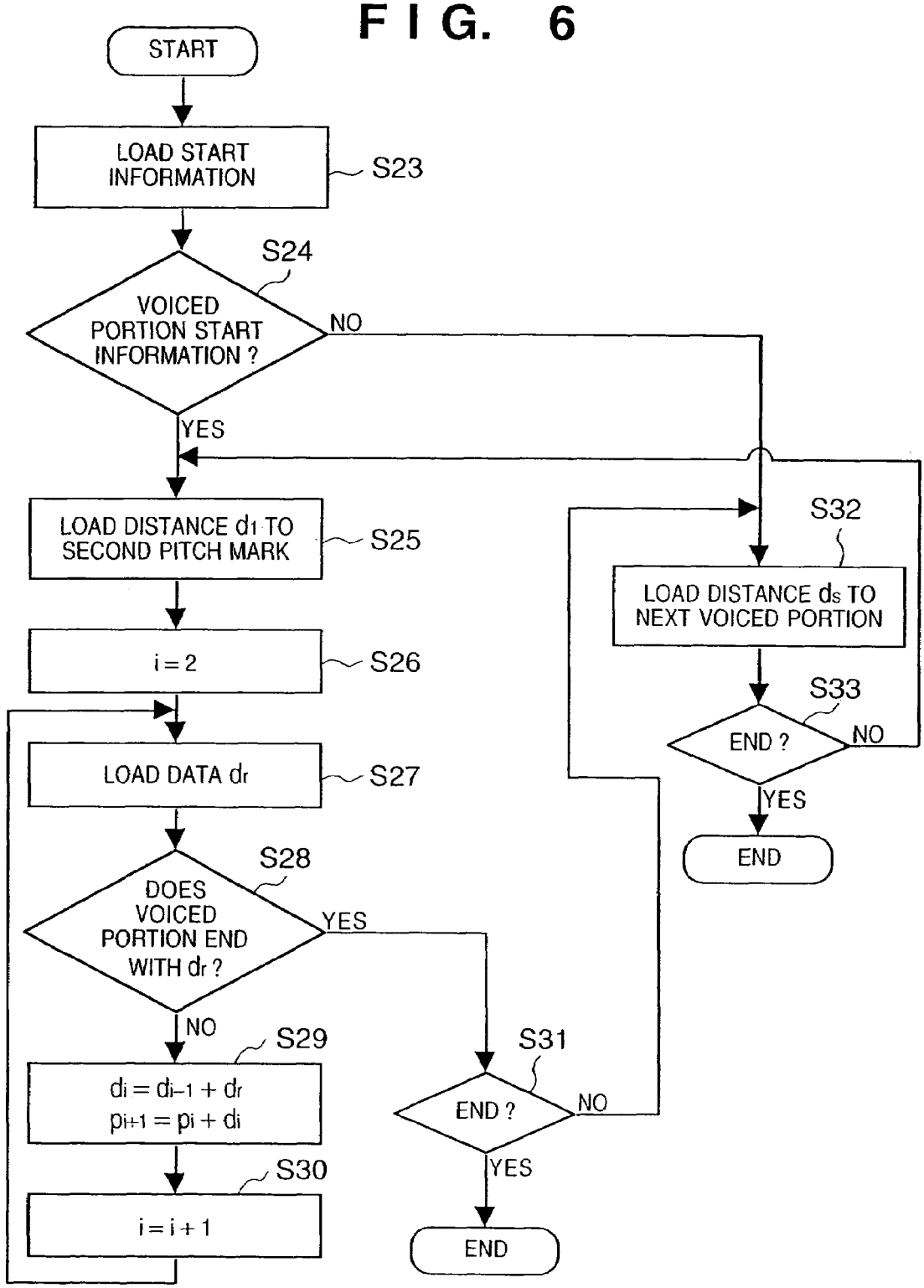
FIG. 6 is a flow chart showing pitch-mark-data, file-loading processing executed in the second embodiment of the present invention.

FIG. 6 is a flow chart showing pitch-mark-data-file loading processing executed in the second embodiment of the present invention.

First of all, in step S23, start information indicating whether the start of speech data to be processed is a voice or unvoiced portion, is loaded from a pitch-mark-data file 101*a*. It is then checked in step S24 whether the loaded start information is voiced portion start information. If voiced portion start information is determined (YES in step S24), the flow advances to step S25 to load a first inter-pitch-mark distance (distance between a first pitch mark $p_1$ and a second pitch mark $p_2$ of the voiced portion) $d_1$ from the pitch-mark-data file 101*a*. Note that the second pitch mark $p_2$ is located at $p_1+d_1$.

In step S26, the value of a loop counter i is initialized to 2. In step S27, a difference $d_r$ (data corresponding the length of one word) from the pitch-mark-data file 101*a*. In step S28, it is checked whether the loaded difference $d_r$ is a voiced portion end signal. If it is determined that the difference is not a voiced portion end signal (NO in step S28), the flow advances to step S29 to calculate the next inter-pitch-mark distance $d_i$ and the pitch mark position $p_{i+1}$ from a pitch mark position $p_i$, the inter-pitch-mark distance $d_{i-1}$, and $d_r$ obtained in the past.

The following equations can be formulated from $p_i$, $d_{i-1}$, $d_r$, $d_i$, and $p_{i+1}$. The next inter-pitch-mark distance $d_i$ and the pitch mark position $p_{i+1}$, can be calculated by using these equations.

$$d_i=d_{i-1}+d_r \tag{1}$$

$$p_{i+1}=p_i+d_i \tag{2}$$

In step S30, the loop counter i is incremented by 1. The flow then returns to step S27.

If it is determined that $d_r$ is a voiced portion end signal (YES in step S28), the flow advances to step S31 to check whether the speech data has ended. If it is determined that the speech data has not ended (NO in step S31), the flow advances to step S32. If it is determined that the speech data has ended (YES in step S31), the processing is terminated.

If it is determined in step S24 that the loaded information is not voiced portion start information (NO in step S24), the flow advances to step S32 to load a distance $d_s$ to the next voiced portion from the pitch mark data file 101*a*. It is then checked in step S33 whether the speech data has ended. If it is determined that the speech data has not ended (NO in step S33), the flow advances to step S25. If it is determined that the speech data has ended (YES in step S33), the processing is terminated.

As described above, according to the second embodiment, since pitch marks can be loaded by using the pitch-mark-data file 101*a* managed by the processing described in the first embodiment, the size of data to be processed decreases to improve processing efficiency.

Another example of the processing of loading pitch marks of each voiced portion in the second embodiment will be described with reference to FIG. 7.

Figure 7:
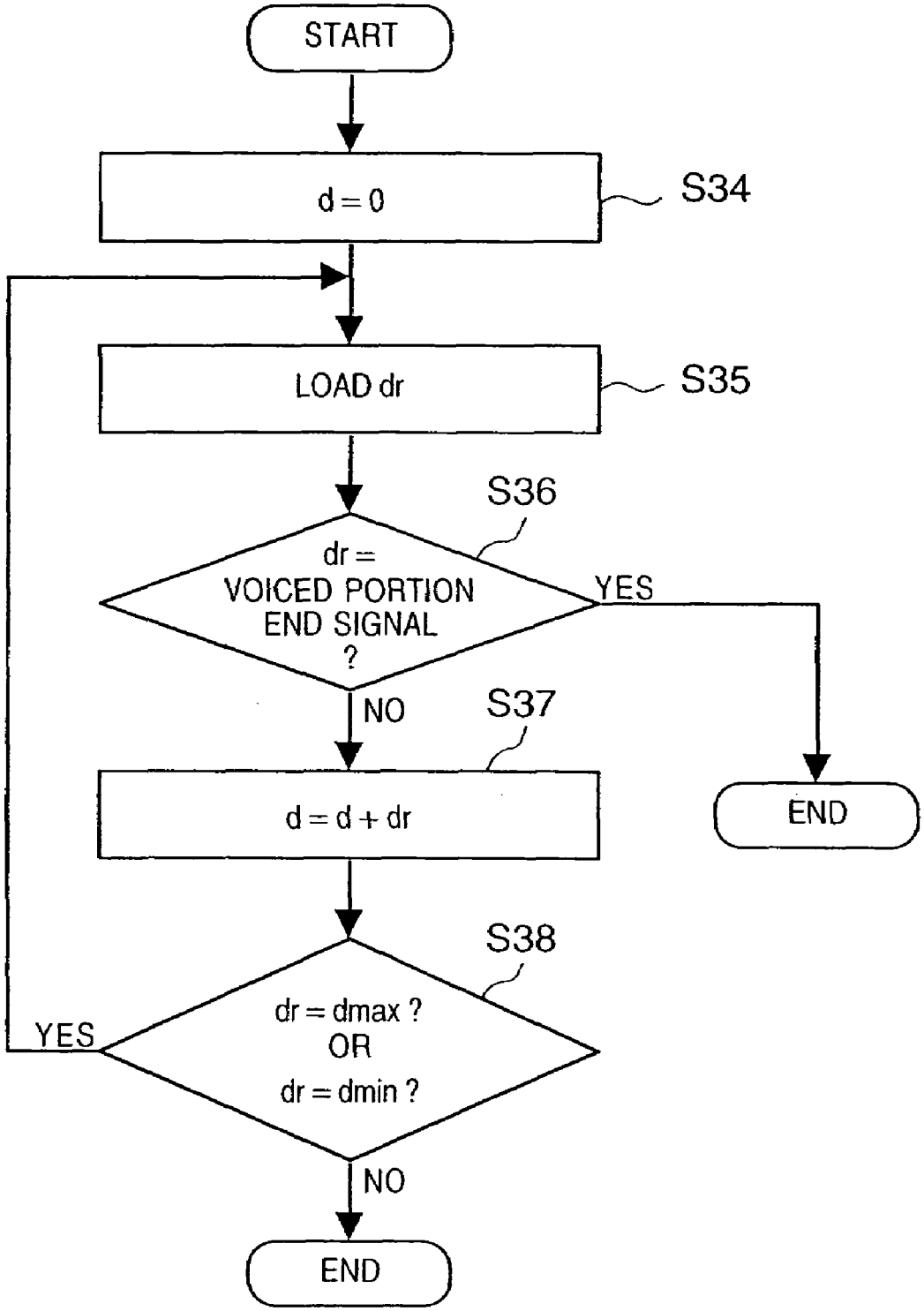
FIG. 7 is a flow chart showing another example of the processing of loading the pitch marks of a voiced portion in the second embodiment of the present invention.

FIG. 7 is a flow chart showing another example of the processing of loading pitch marks of each voiced portion in the second embodiment of the present invention.

Assume that the data-length information of loaded speech data is stored in a register d, and a maximum value dmax (e.g., 127), a minimum value dmin (e.g, −127), and a voiced portion end signal are defined for a given word length (e.g., 8. bits) in FIG. 5.

First of all, in step S34, the register d is initialized to 0. In step S35, the data $d_r$ corresponding to the length of one word is loaded from the pitch-mark-data file 101*a*. It is then checked in step S36 whether $d_r$ is a voiced portion end signal. If it is determined that the $d_r$ is a voiced portion end signal (YES in step S36), the processing is terminated. If it is determined that $d_r$ is not a voiced portion end signal (NO in step S36), the flow advances to step S37 to add $d_r$ to the contents of the register d.

In step S38, it is checked whether $d_r$ is equal to dmax or dmin. If it is determined that they are equal (YES in step S38), the flow returns to step S35. If it is determined that they are not equal (NO in step S38), the processing is terminated.

Note that the present invention may be applied to either a system constituted by a plurality of pieces of equipments (e.g., a host computer, an interface device, a reader, a printer, and the like), or an apparatus consisting of a single piece of equipment (e.g., a copying machine, a facsimile apparatus, or the like).

The objects of the present invention are also achieved by supplying a storage medium, which records a program code of a software program that can realize the functions of the above-mentioned embodiments to the system or apparatus, and reading out and executing the program code stored in the storage medium by a computer (or a CPU or MPU) of the system or apparatus.

In this case, the program code itself read out from the storage medium realizes the functions of the above-mentioned embodiments, and the storage medium which stores the program code constitutes the present invention.

As the storage medium for supplying the program code, for example, a floppy disk, hard disk, optical disk, magneto-optical disk, CD-ROM, CD-R, magnetic tape, nonvolatile memory card, ROM, and the like may be used.

The functions of the above-mentioned embodiments may be realized not only by executing the readout program code by the computer but also by some or all of actual processing operations executed by an OS (operating system) running on the computer on the basis of an instruction of the program code.

Furthermore, the functions of the above-mentioned embodiments may be realized by some or all of actual processing operations executed by a CPU or the like arranged in a function extension board or a function extension unit, which is inserted in or connected to the computer, after the program code read out from the storage medium is written in a memory of the extension board or unit.

As many apparently widely different embodiments of the present invention can be made without departing from the spirit and scope thereof, it is to be understood that the invention is not limited to the specific embodiments thereof except as defined in the appended claims.

What is claimed is:

1. A speech synthesis dictionary creation apparatus for creating speech synthesis dictionaries containing pitch mark data for use in performing speech synthesis by using pitch marks, the apparatus comprising:

first recording means for recording an inter-pitch-mark distance between the first two pitch marks of a voiced portion of speech data to be processed into data for speech synthesis dictionaries;

calculation means for calculating a difference between adjacent inter-pitch-mark distances, which are obtained by calculating distances between adjacent pitch-mark positions; and second recording means for recording the calculation results obtained by said calculation means in the speech synthesis dictionaries, wherein the speech synthesis dictionaries are accessed to generate and output synthesized speech.

2. The apparatus according to claim 1, further comprising counting means for counting the number of pitch marks of the voiced portion, and when the number of pitch marks is counted by said counting means, said second recording means stores the number of pitch marks in a file and manages the number of pitch marks.

3. The apparatus of claim 1, wherein the speech synthesis dictionaries further contain speech data.

4. A method for creating speech synthesis dictionaries containing pitch mark data for use in performing speech synthesis by using pitch marks, the method comprising:

a first recording step for recording an inter-pitch-mark distance between the first two pitch marks of a voiced portion of speech data to be processed into data for speech synthesis dictionaries;

a calculation step for calculating a difference between adjacent inter-pitch-mark distances, which are obtained by calculating distances between adjacent pitch-mark positions; and a second recording step for recording the calculation results obtained in said calculation step in the speech synthesis dictionaries, wherein the speech synthesis dictionaries are accessed to generate and output synthesized speech.

5. The method according to claim 4, further comprising a counting step of counting the number of pitch marks of the voiced portion, and when the number of pitch marks is counted in said counting step, said second recording step stores the number of pitch marks in a file and manages the number of pitch marks.

6. The method of claim 4, wherein the speech synthesis dictionaries further contain speech data.

7. A computer-readable medium storing executable program codes for creating speech synthesis dictionaries, the speech synthesis dictionaries containing pitch mark data for use in performing speech synthesis by using pitch marks, causing a computer to perform the steps comprising:

a first recording step for recording an inter-pitch-mark distance between the first two pitch marks of a voiced portion of speech data to be processed into data for speech synthesis dictionaries;

a calculating step for calculating a difference between adjacent inter-pitch-mark distances, which are obtained by calculating distances between adjacent pitch-mark positions; and a second recording step for recording the calculation results obtained in said calculating step in the speech synthesis dictionaries.

8. The computer-readable medium of claim 7, wherein the speech synthesis dictionaries further contain speech data.

9. A pitch-mark-data file creation apparatus for creating pitch-mark-data files from speech data, the apparatus comprising:

computer processing means for processing speech data, said computer processing means comprising:

(i) a memory for storing data, including speech data and a pitch-mark-data file, the speech data comprising a voiced portion having pitch marks;

(ii) first determination means for accessing the speech data from said memory and determining inter-pitch-mark distances between adjacent pitch marks of the voiced portion of the speech data;

(iii) first recording means for recording in the pitch-mark-data file a first inter-pitch-mark distance between the first two pitch marks of the voiced portion;

(iv) second determination means for determining a difference between the first inter-pitch-mark distance and a second inter-pitch-mark distance determined by said first determination means; and (v) second recording means for recording in the pitch-mark-data file the difference determined by said second determination means, wherein pitch marks of the voiced portion of the speech data can be determined from the first inter-pitch-mark distance determined by said first determination means and the difference determined by said second determination means.

10. The apparatus according to claim 9, further comprising counting means for counting the number of pitch marks of the voiced portion, wherein said second recording means stores in the pitch-mark-data file the number of pitch marks counted by said counting means.

11. A pitch-mark-data file creation method for an information processing apparatus, the information processing apparatus comprising computer processing means for implementing the method and a memory storing speech data and a pitch-mark-data file, the speech data comprising a voiced portion having pitch marks, the method comprising:

(i) a first determination step of accessing the speech data from the memory and determining inter-pitch-mark distances between adjacent pitch marks of the voiced portion of the speech data;

(ii) a first recording step of recording in the pitch-mark-data file a first inter-pitch-mark distance between the first two pitch marks of the voiced portion;

(iii) a second determination step of determining a difference between the first inter-pitch-mark distance and a second inter-pitch-mark distance determined in said first determination step; and (iv) a second recording step of recording in the pitch-mark-data file the difference determined in said second determination step, wherein pitch marks of the voiced portion of the speech data can be determined from the first inter-pitch-mark distance determined in said first determination step and the difference determined in said second determination step.

12. The method according to claim 11, further comprising a counting step of counting the number of pitch marks of the voiced portion, wherein said recording step further comprises recording in the pitch-mark-data file the number of pitch marks counted in said counting step.

13. A computer-readable medium storing executable program codes for creating pitch-mark-data files for use in performing speech synthesis by using pitch marks, causing a computer to perform the steps comprising:

(i) a first determination step of accessing speech data from a memory and determining inter-pitch-mark distances between adjacent pitch marks of a voiced portion of the speech data;

(ii) a first recording step of recording in a pitch-mark-data file a first inter-pitch-mark distance between the first two pitch marks of the voiced portion;

(iii) a second determination step of determining a difference between the first inter-pitch-mark distance and a second inter-pitch-mark distance determined in said first determination step; and (iv) a second recording step of recording in the pitch-mark-data file the difference determined in said second determination step, wherein pitch marks of the voiced portion of the speech data can be determined from the first inter-pitch-mark distance determined in said first determination step and the difference determined in said second determination step.

* * * * *